US007163164B2

(12) United States Patent
Diaz

(10) Patent No.: US 7,163,164 B2
(45) Date of Patent: Jan. 16, 2007

(54) DEVICE FOR GRINDING UP NON-METALLIC PIECES

(75) Inventor: Richard Diaz, Route du Vieux Château, Albigny sur Saone (FR) 69250

(73) Assignees: Richard Diaz, Albigny sur Saone (FR); Gilles Dutour, Chaponnay (FR); Gérard Bery, Marennes (FR)

( * ) Notice: Subject to any disclaimer, the term of this patent is extended or adjusted under 35 U.S.C. 154(b) by 0 days.

(21) Appl. No.: 11/290,361

(22) Filed: Nov. 30, 2005

(65) Prior Publication Data

US 2006/0079101 A1 Apr. 13, 2006

Related U.S. Application Data

(63) Continuation of application No. PCT/EP2004/050636, filed on Apr. 29, 2004.

(30) Foreign Application Priority Data

Jun. 16, 2003 (FR) ..... 03 07213

(51) Int. Cl.
*B02C 25/00* (2006.01)

(52) U.S. Cl. ..... 241/36; 241/243

(58) Field of Classification Search ..... 241/242, 241/243, 36, 37.5

See application file for complete search history.

(56) References Cited

U.S. PATENT DOCUMENTS 5,297,744 A 3/1994 Clinton

FOREIGN PATENT DOCUMENTS

| | | |
|---|---|---|
| FR | 2 700 278 A1 | 7/1994 |
| JP | 08-168686 A1 | 7/1996 |

*Primary Examiner*—Mark Rosenbaum
(74) *Attorney, Agent, or Firm*—Burr & Brown

(57) ABSTRACT

A grinding device including at least one motor-driven rotating shaft near the bottom of a receptacle for receiving non-metallic pieces to grind up. The shaft has teeth, which shred and grind the non-metallic pieces and which are radially arranged in rows on the periphery of the shaft. The shaft teeth cooperate with teeth of at least one fixed comb, which is attached to a receptacle and divides the receptacle into an upper part situated above the comb and a lower part located underneath the comb. The fixed comb includes an electrically conductive base brought to a specified potential. An electrically conductive surface, which is oriented toward the upper part of the receptacle, is electrically separated from the base, and is brought to a potential that is different from that of the base, in order to detect the presence of metallic pieces by the completion of the electrical circuit created thereby.

10 Claims, 3 Drawing Sheets

DEVICE FOR GRINDING UP NON-METALLIC PIECES

FIELD OF THE INVENTION

The invention relates to the field of recycling non-metal materials. It relates to a grinding device for non-metal parts capable of reducing parts made of plastic, in particular, into granules.

It more especially relates to a means of detecting the presence of metal parts inside the device.

DESCRIPTION OF THE PRIOR ART

Generally speaking, machines for recycling non-metal parts comprise a grinding device in order to produce granules capable of being reused in order to manufacture new parts by injection moulding or extrusion moulding for example.

Nevertheless, metal parts are sometimes put into the grinding device because they are used, for example, as a means of fixing the parts that are to be ground onto a structure, e.g. car bumpers that are fixed onto the chassis by metal rivets. If metal parts get inside the grinder, there is a risk of them damaging the teeth of the grinder and also risk of them blocking injection or extrusion nozzles when the granules are subsequently used.

Metal parts are not detected inside grinding devices. This operation is traditionally performed upstream from grinding inside the mechanism that feeds in the parts to be ground, e.g. by magnetic means that are difficult to use and expensive.

Document FR 2,700,278 describes a feed system for a device for grinding non-metal parts. This system is equipped with a device for detecting metal parts by means of a short bar arranged longitudinally in the machine and electrically insulated from the chassis of the machine. A circuit is then made when a metal part is in contact with both the short bar and the chassis.

However, this detection device does not make it possible to detect metal parts that are embedded in non-metal materials. In addition, it is located upstream from the grinder and, consequently, metal parts frequently reach the grinding device, then causing considerable damage. Similarly, metal parts can be introduced by mistake between the two operations and this can damage the grinder and block injection or extrusion nozzles.

SUMMARY OF THE INVENTION

The object of the invention is to overcome this drawback in a simple, reliable and effective manner.

The invention aims firstly to obtain detection of metal parts located inside a grinding device and secondly to then trigger automatic switch-off of the grinding device, especially for grinders which have a shaft that rotates slowly.

In order to solve this problem, a grinding device for non-metal parts comprising a motor-driven rotating shaft inside a receptacle has been developed. The shaft has a plurality of teeth intended to shred and grind the non-metal parts. The teeth are arranged radially in rows over the periphery of the shaft so as to cooperate, when they rotate, with the teeth of at least one fixed comb attached to the receptacle and dividing the receptacle in an upper part located above the comb and a lower part located underneath the comb.

According to the invention, the fixed comb comprises an electrically conducting base held at a specific potential and an electrically conducting surface that faces the upper part of the receptacle and is electrically insulated from the base and held at a potential that is different to that of the base. This configuration makes it possible to detect the presence of metal parts by making the electrical circuit between the surface and the base.

In other words, the electrically conducting surface which is electrically insulated from the base of the comb is in the area where the grinding device is fed with non-metal parts. When a metal part comes into contact with this conducting surface and the base of the comb simultaneously, this causes a "short-circuit" or more simply causes a variation in resistance which can, in particular, be likened to a Wheatstone bridge. It is deduced from this variation or change of state that a metal part is present in the area where such a grinding device is fed with non-metal materials.

According to the invention, the grinding device may comprise a plurality of combs capable of detecting the presence of metal parts and which are arranged either side of the longitudinal median plane of the device. In other words, the combs make it possible to split the device into two spaces, the first space being the feed space, also called the upper part of the device if the feed is a gravity feed, the second space accommodating the granules of non-metal materials, also called the lower part of the device if the feed is a gravity feed.

Advantageously, the electrical potentials of the base of the comb and of the teeth of the motor-driven rotating shaft are identical. In fact, because the distance between these two components is minimal, a potential difference between these two components could cause electrical arcing which would make the circuit and impair the effectiveness of detection.

In practice, the base of the comb and the teeth of the motor-driven rotating shaft have a zero potential. In this case they are connected to the ground of the device.

According to a first embodiment of the invention, the conducting surface consists of a conducting sheet secured on the base of the comb by at least one electrically insulated fastener.

In practice, the electrically insulated fastener is a screw having the same potential as that of the base. This screw passes through a hole in the sheet and then secures the sheet by means of its head.

An electrically insulating hardenable material is then inserted between the base, the sheet and the screw in order to electrically insulate the sheet from the base.

In another embodiment of the invention, the conducting surface consists of a conducting metal section inserted into a groove chased into the base and coated in an insulating resin. This section is inserted into the groove previously filled with adhesive, the upper surface thus produced then being precision-ground, thereby eliminating the resin on the conducting surface in order to ensure conduction.

According to the invention, the conducting sheet is electrically connected to the control unit of the device. Thus, when the circuit is made by a metal part that straddles the conducting sheet and the base of the comb, the control unit stops rotation of the motor-driven shaft and sends a signal to a display. This display informs the operator of the device of the reason why the device was switched off. This display can be, depending on the embodiment chosen, an indicator lamp or a message on a screen-type device. The operator must then remove the metal part that caused the short-circuit and then switch the device back on again.

BRIEF DESCRIPTION OF THE DRAWINGS

In order that the present invention and its resulting advantages may more readily be understood, the following description of various embodiments is given, merely by way of example, reference being made to the accompanying drawings in which.

DESCRIPTION OF THE PREFERRED EMBODIMENTS

As already stated, the invention relates to a device for grinding non-metal parts comprising at least one fixed comb capable of detecting the presence of metal parts inside said grinding device.

Figure 1:
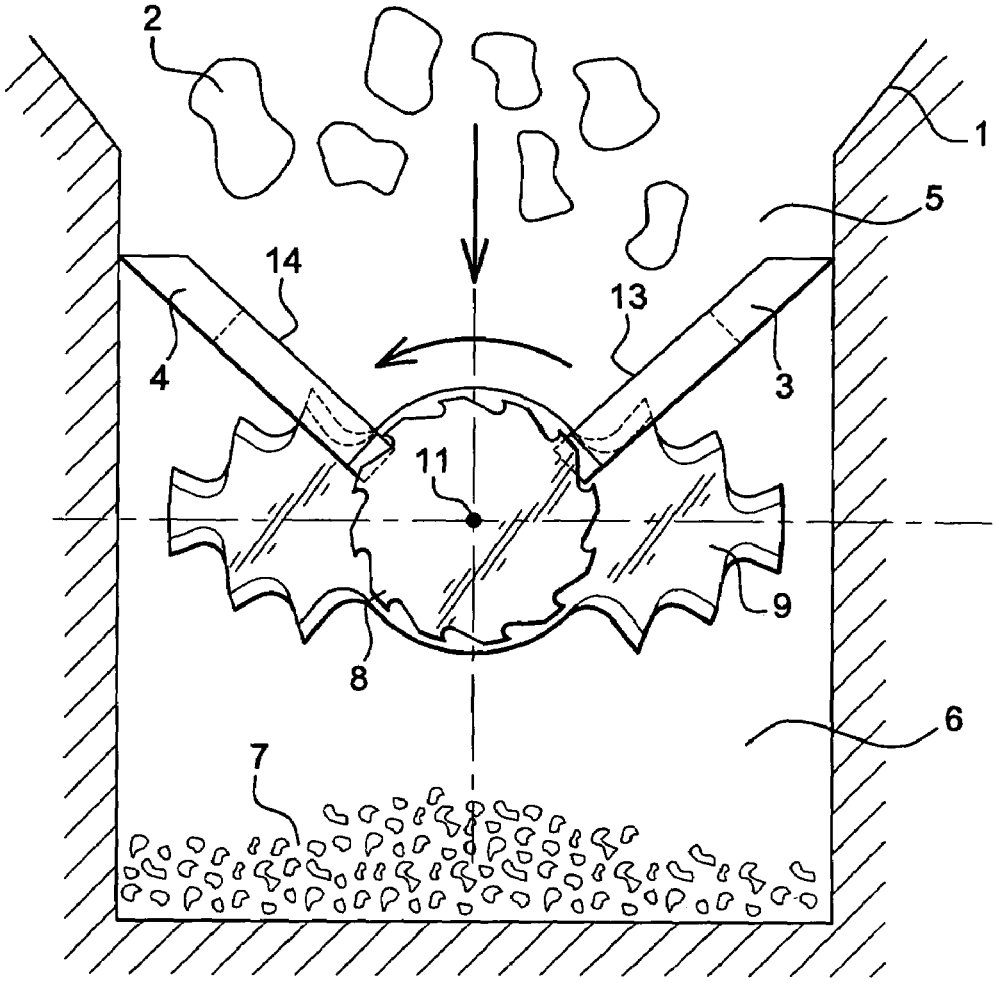
FIG. 1 is a cross-sectional view of the grinder in accordance with the invention.

As shown in FIG. 1, the grinding device (1) comprises a receptacle which is divided into an upper part (5) into which non-metal parts (2) intended to be ground are fed. A motor-driven rotating shaft (11) is located in the lower part (6) of the grinding device (1). Shaft (11) has a plurality of teeth (8) arranged radially in rows around the periphery of the shaft. It also comprises one or more large blades (9) that extend radially from the shaft and are capable of slicing through large non-metal parts (2) fed into the device.

The teeth (8, 9) cooperate, as they rotate, with the teeth (15) of at least one fixed comb (4). This area constitutes the boundary between the upper part (5) and the lower part (6) of the grinding device (1).

When non-metal parts (2) drop into grinding device (1) they are initially pressed against comb (4) and then gradually shredded so as to form granules (7) of non-metal material inside lower part (6).

Figure 2:
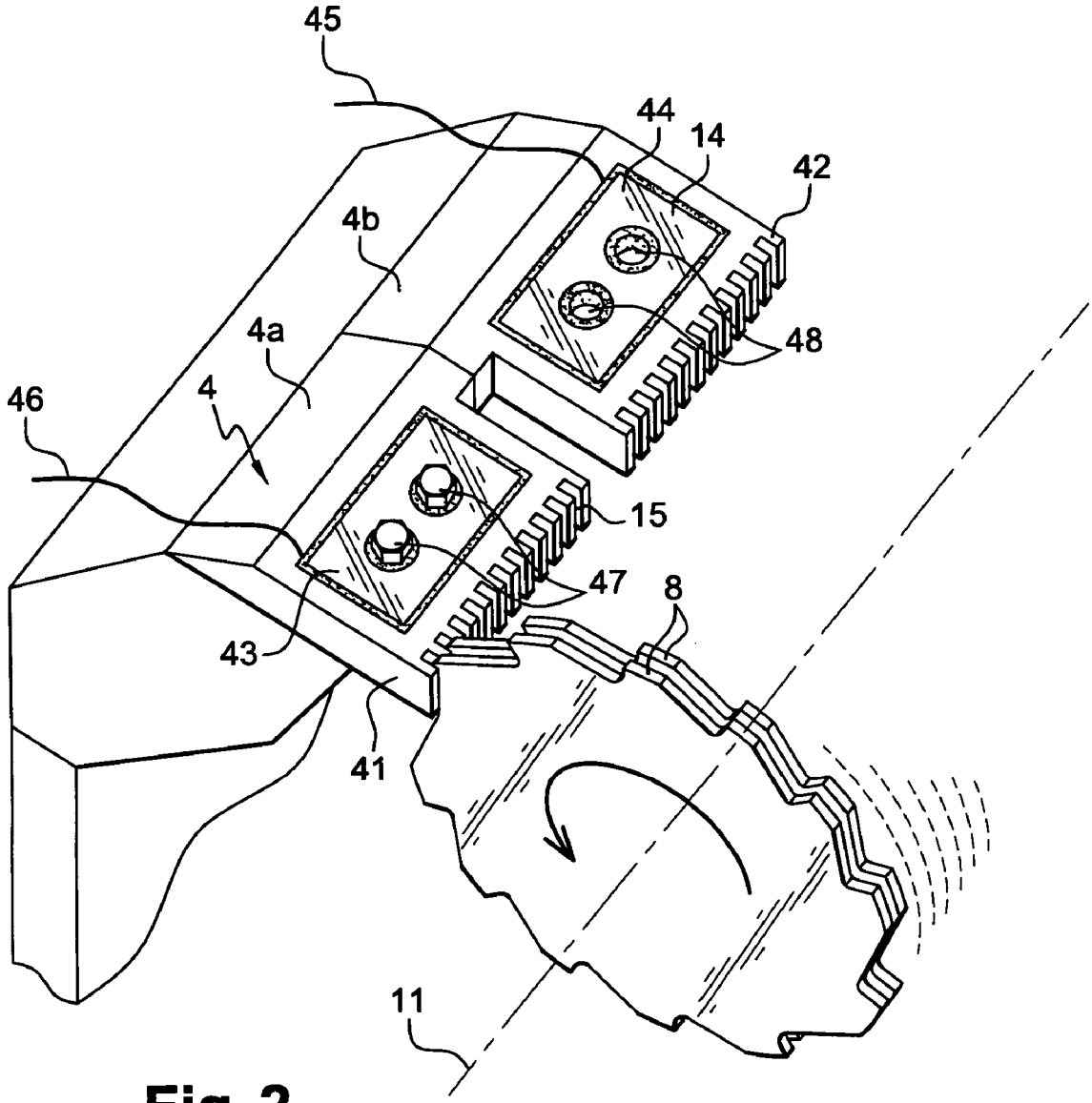
FIG. 2 is a perspective view of two combs capable of detecting the presence of metal parts in accordance with the invention.

As shown in FIG. 2, comb (4) may consist of two sections (4*a*, 4*b*) with a central gap through which blades (9) can pass. It also has teeth (15) which allow the teeth (8) of the motor-driven shaft to rotate freely, thereby producing granules through cooperation of teeth (8) and (5) with each other. According to the invention, the comb comprises an electrically conducting base (41, 42) that is held at a specific potential and an electrically conducting surface (14) that faces the upper part (5) of grinder (1) and is held at a potential different to that of base (41, 42) so as to detect the presence of metal parts by making the electrical circuit thus produced.

Advantageously, the potential of base (41, 42) is the ground of the device (1).

According to a first embodiment of the invention, surface (14) of comb (4) is made by means of conducting sheets (43, 44) that are electrically insulated from base (41, 42) of comb (4). Each conducting sheet (43, 44) is secured relative to comb (4) by at least two screws (47). Each of the screws (47) passes through a hole (48) in sheet (43, 44) and secures the sheet (43, 44) by means of its head.

Figure 3:
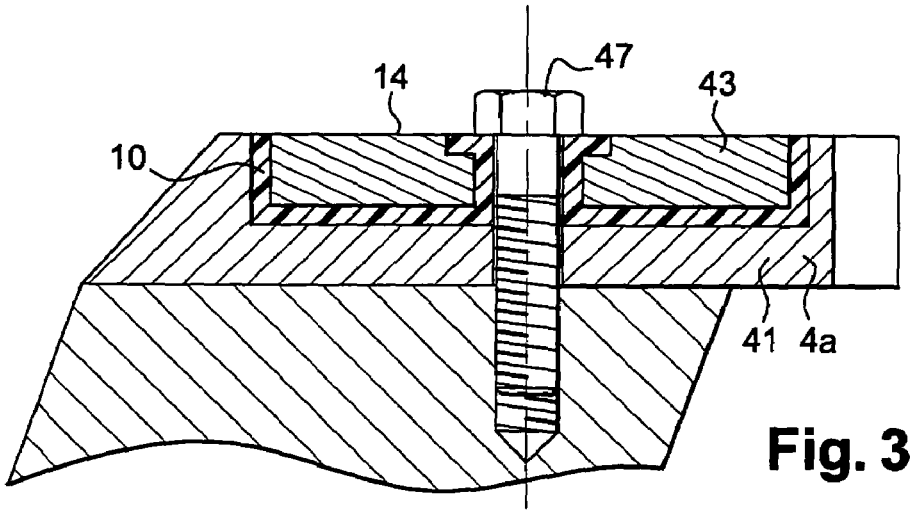
FIG. 3 is a cross-sectional view of a comb in accordance with a first embodiment of the invention.

As shown in FIG. 3, the screw (47) is electrically insulated from sheet (43). In this way, the screw has the same potential as base (41) of comb (4*a*).

Figure 4:
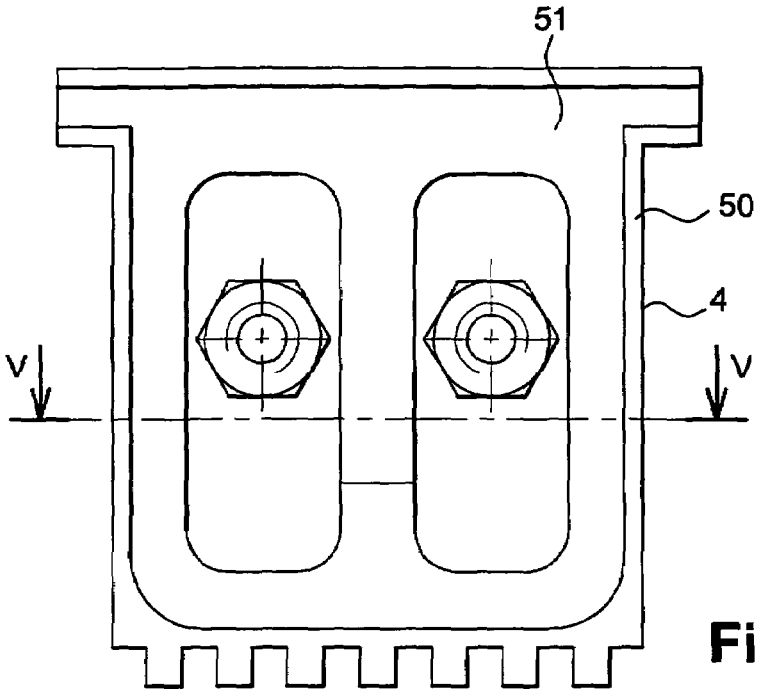
FIG. 4 is a schematic top view of a comb in accordance with a second embodiment of the invention.
Figure 5:
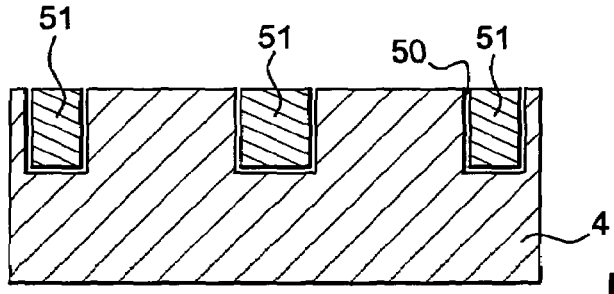
FIG. 5 is a cross-sectional view along line V—V in FIG. 4.
Figure 6:
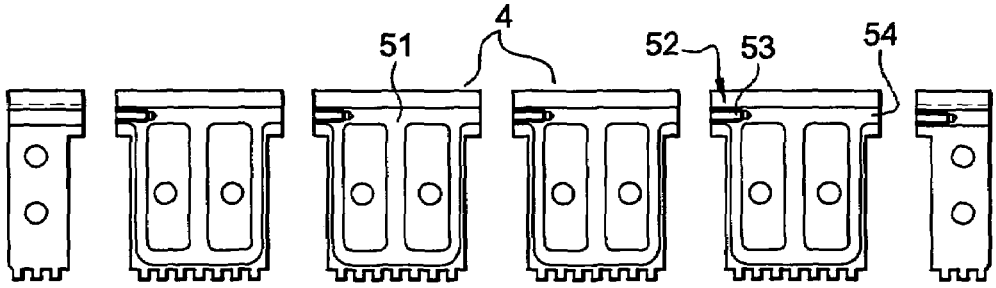
FIG. 6 is a schematic view of a plurality of juxtaposed combs designed in accordance with the second embodiment of the invention.

According to another embodiment of the invention (FIGS. 4 and 5) a groove (50) is made on the upper surface of the base, especially by machining, extending substantially over all or part of its periphery and also along its median plane. This groove is intended to accommodate the conducting upper surface (14) which consists of a conducting metal section (51), the shape of which matches said groove.

This section is coated, for example by immersion, in an insulating resin such as polyamide to a thickness of approximately three tenths of a millimetre. Once this resin dries, groove (50) is filled with adhesive, for example cyanoacrylate adhesive, and said section (51) is then pushed into groove (50). After the adhesive has cured, the upper surface of the comb is precision-ground in order to flatten it and, in particular, to expose the upper conducting surface of section (51).

Such an embodiment makes it possible to avoid having to use a mechanical link between the conducting surface and the base of the comb.

Sheet (43, 44) or section (51) is linked by a wire (45, 46) to the control unit of grinding device (1). When a metal part comes into contact with both sheet (43, 44) or section (51) and base (41, 42) of comb (4) an electrical circuit is then made and the control unit automatically stops rotation of the motor-driven shaft (11). The control unit then sends a signal to a display in order to inform the operator of the reason why the device (1) was switched off.

In order not to increase the number of wire links if a plurality of combs is used, sections (51) are placed in contact with each other by means of a cone-point set screw (52) or a screw having, at each of its two ends, a ball, which is housed inside an outer enclosure (53) made of an electrically non-conducting material and having a thread. This screw is accommodated in a bore (54) in the lateral surface of each of the combs that opens out into groove (50) of the combs so that it is in contact with conducting section (51).

This being so, all the sections are held at the same potential without short-circuiting the base of the combs.

It is apparent from the above description of a device in accordance with the invention that it has several advantages, in particular:

- It makes it possible to significantly reduce the risks posed by the presence of metal parts inside a grinding device of this type;
- It can very easily be adapted to grinding devices which are used in the industry;
- Its simple operation makes it a dependable, affordable item of equipment.

The invention claimed is:

1. A device for grinding (1) non-metal parts (2) comprising at least one motor-driven rotating shaft (11) inside a receptacle that receives non-metal parts that are to be ground, said shaft (11) having a plurality of teeth (8) intended to shred and grind said non-metal parts (2), said teeth (8) being arranged radially in rows around the periphery of shaft (11) so as to cooperate, when they rotate, with teeth (15) of at least one fixed comb (4, 4*a*, 4*b*) attached to the receptacle and dividing the receptacle into an upper part (5) located above comb (4, 4*a*, 4*b*) and a lower part (6) located underneath comb (4, 4*a*, 4*b*) characterised in that said fixed comb (4, 4*a*, 4*b*) comprises an electrically conducting base (41, 42) held at a specific potential and an electrically conducting surface (14) that faces the upper part (5) of the receptacle and is electrically insulated from said base (41, 42) and held at a potential that is different to that of base (41, 42) so as to detect the presence of metal parts by making the electrical circuit thus produced.

2. A grinding device as claimed in claim 1, characterised in that it comprises a plurality of combs (3, 4) capable of detecting the presence of metal parts either side of the longitudinal median plane of the grinding device (1).

3. A grinding device as claimed in claim 1, characterised in that the electrical potentials of the base (41, 42) and the teeth (8) of the motor-driven rotating shaft (11) are identical.

4. A grinding device as claimed in claim 3, characterised in that the base (41, 42) and teeth (8) of motor-driven rotating shaft (11) are held at zero potential.

5. A grinding device as claimed in claim 1, characterised in that conducting surface (14) consists of a conducting sheet (43, 44) secured on base (41, 42) by at least one electrically insulated fastener.

6. A grinding device as claimed in claim 5, characterised in that the electrically insulated fastener consists of a screw (47) held at the same potential as that of base (41, 42), said screw (47) passing through a hole (48) in sheet (43, 44) and securing sheet (43, 44) by means of its head.

7. A grinding device as claimed in claim 6, characterised in that an electrically insulating hardenable material (10) is inserted between base (41, 42), sheet (43, 44) and screw (47) so as to electrically insulate sheet (43, 44) from base (41, 42).

8. A grinding device as claimed in claim 1, characterised in that the conducting surface (14) consists of an electrically conducting section (51) accommodated in a groove (50) of matching shape made in the upper surface of the comb and extending substantially along all or part of its periphery and also along its median plane, said section being coated in an insulating resin before being bonded into said groove.

9. A grinding device as claimed in claim 8, characterised in that said sections (51) of a single row of combs are electrically connected to each other by means of cone-point set screws or screws with a ball at both their ends and housed in an outer enclosure made of an electrically non-conducting material having a thread, each of said screws being intended to be accommodated in a bore in the lateral surface of each of the combs and opening out into groove (50) which they have, so as to be in contact with conducting section (51).

10. A grinding device as claimed in claim 1, characterised in that conducting sheet (43, 44) or section (51) is electrically connected to a control unit of device (1) intended to stop rotation of motor-driven shaft (11) when the circuit is made by a metal part.

* * * * *